US009736563B1

(12) United States Patent
Glass et al.

(10) Patent No.: US 9,736,563 B1
(45) Date of Patent: Aug. 15, 2017

(54) UNILATERAL DUAL TRANSDUCER STEREO HEADPHONE

(76) Inventors: Daniel Jeremy Glass, Somerville, MA (US); Mishah Uzziel Salman, Brooklyn, NY (US)

( * ) Notice: Subject to any disclaimer, the term of this patent is extended or adjusted under 35 U.S.C. 154(b) by 755 days.

(21) Appl. No.: 13/614,768

(22) Filed: Sep. 13, 2012

(51) Int. Cl.
*H04R 1/10* (2006.01)
*H04R 5/033* (2006.01)

(52) U.S. Cl.
CPC ..... *H04R 1/1008* (2013.01); *H04R 5/033* (2013.01)

(58) Field of Classification Search
CPC ..... H04S 1/00; H04S 1/005; H04R 2205/022; H04R 5/04; H04R 1/10–1/1091; H04R 5/033; H04R 5/0335; H04R 2201/10–2201/109; H04R 1/1008
USPC ..... 381/308
See application file for complete search history.

(56) References Cited

U.S. PATENT DOCUMENTS 3,794,779 A * 2/1974 Greuzerd ..... H04R 1/1075 381/19
4,041,256 A * 8/1977 Ohta ..... H04R 1/1058 381/371
4,529,057 A * 7/1985 Telford ..... A61F 11/14 128/868
6,038,330 A * 3/2000 Meucci, Jr. ..... H04R 1/1075 345/8
2004/0076306 A1* 4/2004 Pan ..... H04R 5/033 381/370
2005/0207607 A1* 9/2005 Yang ..... H04R 1/1075 381/382
2008/0279404 A1* 11/2008 Kuo ..... H04R 1/1075 381/311
2008/0304683 A1* 12/2008 Kuo ..... H04R 1/1075 381/309
2010/0128885 A1* 5/2010 Roos ..... A61F 11/14 381/72
2010/0166237 A1* 7/2010 Leeper ..... H04R 5/04 381/309
2010/0246864 A1* 9/2010 Hildebrandt ..... H04R 3/04 381/310

(Continued)

FOREIGN PATENT DOCUMENTS

GB 2261343 A * 5/1993 ..... H04R 1/1016
GB 2367705 A * 4/2002 ..... H04R 1/1075

OTHER PUBLICATIONS

IBM, Switches for Side-Interchangeable Stereo Earphone, Mar. 2002, IP.com.*

*Primary Examiner* — Mark Fischer
(74) *Attorney, Agent, or Firm* — Russ Weinzimmer & Associates, PC

(57) ABSTRACT

One embodiment of a headphone in which both the left and right stereo channels are contained within a single earpiece (10) and separated by vertical positioning above (12) and below (14) the ear, rather than each ear receiving one stereo channel, as in traditional headphones. This allows the listener to hear the audio content of both stereo channels with a single ear, while still being able to distinguish between the two channels. The other earpiece of the headphone may be a "dummy" (20) which contains no speaker, and the headphone can be reversed depending on which ear the user wants to listen with. Optionally, the back of each earpiece can be opened, allowing the listener to experience stereo sound in one ear while listening to his/her surroundings with the other.

9 Claims, 3 Drawing Sheets

(56) References Cited

U.S. PATENT DOCUMENTS

Figure 1:
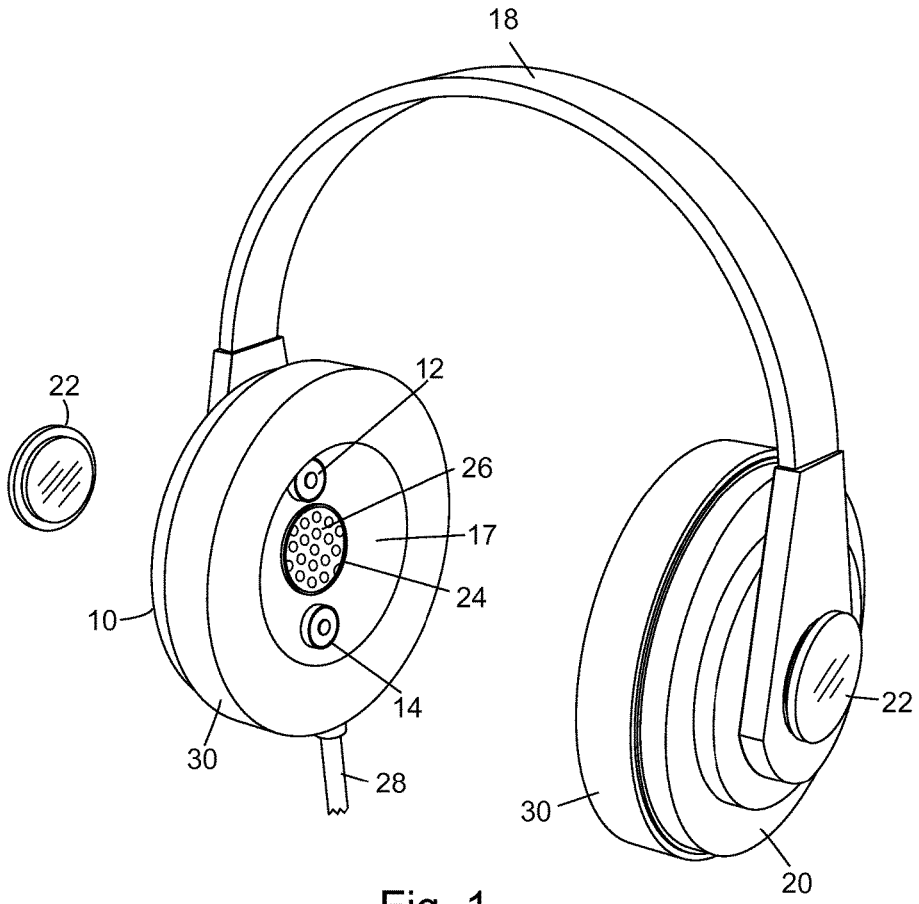

| | | | | |
|---|---|---|---|---|
| 2010/0246878 | A1* | 9/2010 | Sim | H04R 1/1041<br>381/380 |
| 2013/0142376 | A1* | 6/2013 | Lin | H04R 1/1008<br>381/373 |

* cited by examiner

UNILATERAL DUAL TRANSDUCER STEREO HEADPHONE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

Field

This application relates to audio headphones, specifically an improved mechanism for stereo headphones.

Prior Art

As many audiophiles and laypeople are aware, most contemporary commercial audio recordings are split into two stereo channels, generally designated as "Left" and "Right"; this is true of radio and television broadcasts, video games, and recorded music or sound on all modern media. Traditional headphones, which have two earpieces, separate these two channels by sending one to each ear. The listener perceives these two signals as an integrated whole, but is also able to recognize that the sound from the right channel may differ from that of the left; while the content of two channels may be identical, it is common for the musician, producer, or engineer to place certain instruments/vocals/etc. at different volumes in the two channels, to place them in one channel but not the other, or to "pan" them back and forth between the left and right channels, creating the effect of "sound movement" for the listener.

Thus, stereo separation is an important aspect of the recording of audio, for both aesthetic and functional purposes; the ability of the listener to hear and distinguish between the two stereo channels is a key aspect of the listening experience, whether for the full enjoyment of a musical recording or to recognize the direction of approach of an enemy in a computer game.

Each year, 60,000 individuals in the U.S. are diagnosed with unilateral (i.e., single-ear) deafness or hearing loss. Many of these individuals regularly use headphones to listen to music or other sound recordings, play games, and watch video; unlike the general population, however, most of these listeners are missing half of the "sonic picture." They generally use conventional headphones, and thus can only hear the single audio channel that is going into their functional ear; they are likely to miss some of the effects afforded by the relative positioning and "motion" of sound between the two channels, and (if any portions of the music are solely in the channel of their impaired ear) might even be completely unable to hear certain instruments or vocals.

Several options are available for people with unilateral hearing loss who wish to experience both halves of their audio recordings through headphones. Monaural (one-channel) headsets/earpieces do exist, but these simply remove one of the two stereo channels altogether rather than combining them into one earpiece, so the listener is no better off than with stereo headphones. Using a stereo-to-mono adapter with mono headphones does achieve the desired effect, but these adapters can make portable devices awkward to carry, as they are prone to breaking, which can damage the audio output of the device. Furthermore, combining the stereo channels in this manner can short-circuit the audio device and cause damage. Additionally, since both channels are perceived through a single sound source, listeners using this method are unable to appreciate the channel separation, stereo width, and side-to-side panning that are a crucial part of the stereo experience. Finally, the transmission of dual audio signals through a single earphone source can lead to less-than-optimal sound quality, because the two signals can interfere with each other, boosting some frequencies of the audio signal and canceling out others.

Lately, it has become possible to purchase headphones/earbuds that combine both stereo channels into a single earpiece, allowing listeners to plug straight into their devices without the use of the aforementioned stereo-to-mono adapter. This type of headphone is currently the best solution available to listeners with unilateral hearing loss, but it is not without its problems. These headphones are usually custom-made by boutique brands, with premium price tags to match. As they utilize a single speaker, they are subject to the same weaknesses as the mono headphones and adapter: a lack of stereo separation and the likelihood of signal interference. Additionally, many listeners with unilateral hearing loss like to have an earpiece covering both ears while using headphones in public, to avoid someone attempting to speak into their deaf ear; single stereo earbuds leave the impaired ear exposed, so some individuals instead opt for the less ideal traditional headphones or earbuds to avoid awkward social moments.

"Surround sound" headphones have multiple sound sources in each earpiece which are designed to simulate the "front" and "rear" channels of a surround sound-enabled movies and games, but the "left" and "right" stereo channels still go to the corresponding ear in these products, leaving unilaterally deaf users still missing half of the action.

SUMMARY

In accordance with one embodiment, a pair of circumaural (full-size, over-ear) headphones in which each stereo channel (left and right) is transmitted through its own transducer (i.e., speaker) within a single earpiece, rather than one stereo channel in each earpiece as in standard headphones, and as opposed to both channels through a single transducer as in currently available solutions. The use of two separate transducers placed outside the external auditory canal (e.g., one above and one below the ear, in the preferred embodiment) provides a fuller, clearer sound in which the channels can be distinguished and thus the perception of stereo space can be achieved.

DRAWINGS—FIGURES

Figure 2A:
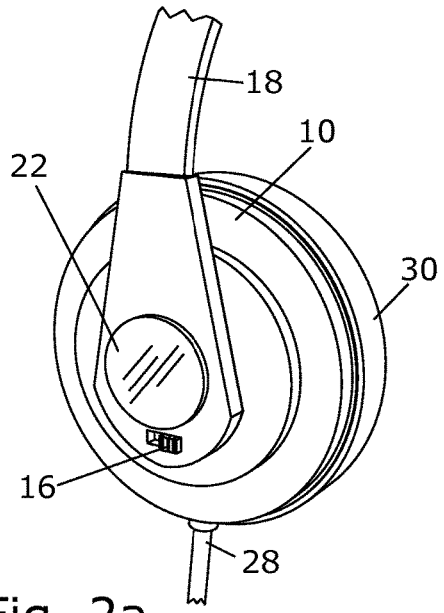
Figure 2B:
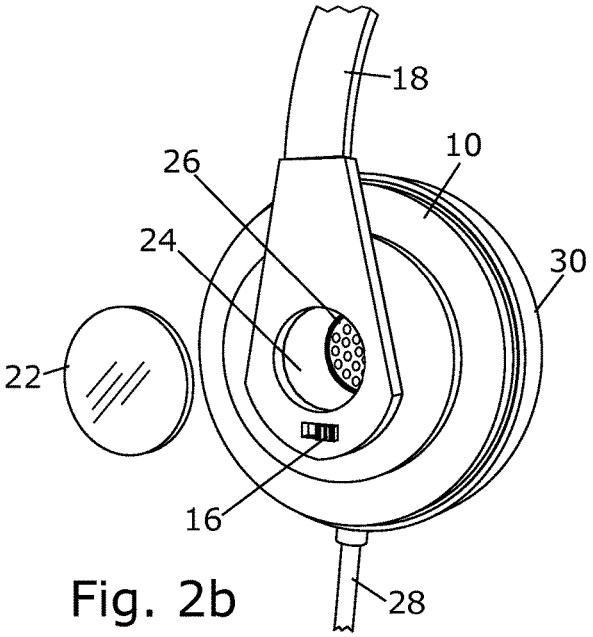

While the basic structure of one embodiment is the same as that of a standard headphone, there are several important differences which will be clear in the following figures:

FIG. 1 depicts one embodiment of the device, showing an inside view of the functional earpiece;

FIG. 2*a* is an outside view of the functional earpiece when the back is closed with removable clip-on cover; and FIG. 2*b* is an outside view of the functional earpiece when the clip-on cover has been removed and thus the back is open.

Figure 3:
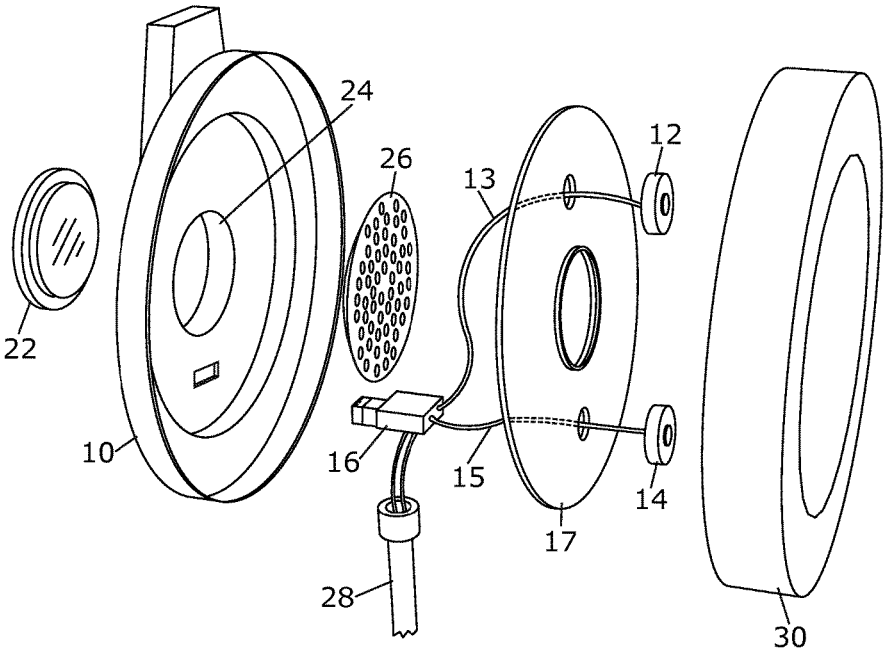

FIG. 3 is an exploded view of the functional earpiece, showing the assembly and inside.

| DRAWINGS - Reference Numerals | | | |
|---|---|---|---|
| 10 | Functional earpiece | 12 | Upper transducer |
| 13 | Wire for upper transducer | 14 | Lower transducer |
| 15 | Wire for lower transducer | 16 | Channel switch |
| 17 | Circular mount | 18 | Headband |
| 20 | Dummy earpiece | 22 | Removable cap |
| 24 | Cavity | 26 | Protective screen |
| 28 | Cord | 30 | Earpad |

DETAILED DESCRIPTION OF FIRST EMBODIMENT

As shown in FIG. 1, one embodiment of the device is similar to standard circumaural (over-the-ear) headphones. However, rather than the acoustical drivers, speakers, or transducers 12, 14 being placed in opposite earpieces as in a standard headphone, they are placed in the same earpiece 10—one above the external ear opening 12 and one below it 14, allowing for the two channels to be distinguished, and sonic differences and movement between the two channels to be recognized. The shape of the outer ear, which normally allows us to vertically localize ambient sounds, will also allow the user to distinguish between the "left" and "right" channels, which are now effectively "top" and "bottom" channels. Wires 13 and 15 run from the upper and lower transducers, respectively (FIG. 3).

An optional two-way switch 16 (visible in FIGS. 2*a*, 2*b*, and 3) swaps the left and right channels, based on user preference (so the "left" channel can come through the top transducer and the "right" channel through the bottom, or vice versa). In the preferred embodiment, the transducers can be held in place via a circular mount 17 (FIGS. 1 and 3).

The earpiece on the opposite side 20 (see FIG. 1) can be a "dummy" earpiece which contains no transducers. This dummy earpiece 20 may look similar to the functional earpiece 10 from the outside, but may not require a switch 16, as it contains no audio components within. In the preferred embodiment, as seen in FIG. 1, a standard headband 18 connects the two earpieces, and the headphone may be "reversible"—i.e., can be worn with the functional earpiece 10 on either the left or the right ear—depending on the user's needs.

In the preferred embodiment, the back of each earpiece 10, 20 may be closed (as seen in FIG. 2*a*) or opened (as in FIG. 2*b*) via a removable clip-on cap 22 (visible in FIGS. 1, 2*a*, 2*b*, and 3). Other possible embodiments may omit the removable caps 22 and utilize either open or closed back earpieces. See also FIG. 1, in which the functional earpiece 10 is open and the dummy earpiece 20 is closed, for illustrative purposes. In the preferred embodiment, both earpieces 10, 20 (as well as the circular mount 17 within) have a cavity 24 (visible in FIGS. 1, 2*b*, and 3) which leads from one side of the earpiece to the other (i.e., each earpiece is essentially "donut-shaped"). A fixed protective screen 26 (visible in FIGS. 1, 2*b*, and 3) can be used to cover each cavity, letting sound through while providing a shield against foreign objects. The cavities and removable caps allow individuals with normal hearing to listen to music with one ear while attending to their surroundings with the other, and also permits listeners with unilateral deafness to decide whether they wish to monitor their surroundings (by opening the earpiece) or shut out external noise entirely (by closing it). In the preferred embodiment, a standard headphone cord 28 (seen in FIGS. 1, 2*a*, 2*b*, and 3) runs from the functional earpiece 10 and terminates in a standard 3.5 mm stereo plug (not pictured). Also in the preferred embodiment, each earpiece 10, 20 features standard earpads 30 for comfort (FIGS. 1, 2*a*, 2*b*, and 3). The transducers 12, 14 and mount 17 (i.e., the inside of the functional earcup 10) may also be covered with a protective screen (not pictured) underneath the earpad 30 to protect the transducers 12, 14; the dummy earcup 20 may have a similar screen.

ADVANTAGES

From the description above, a number of advantages of some embodiments of this stereo headphone become evident:

(a) Users who are unilaterally deaf or choose to listen with only one ear may finally hear both left and right stereo channels.

(b) These listeners can perceive relative space and motion between stereo channels, since the two transducers are spatially separated.

(c) The two stereo channels sound better because they are each coming through a different transducer, rather than both coming through a single transducer.

(d) The optional channel switch allows the user to select which channel (left or right) is heard through which transducer (top or bottom).

(e) The optional removable clip-on caps allow the user the choice of either monitoring or blocking out his/her surroundings.

CONCLUSION, RAMIFICATIONS, AND SCOPE

Above, we have demonstrated that this embodiment of the headphones allows unilaterally deaf users and those who wish to listen with only one ear to hear higher quality, more complete audio in which the left and right channels can be both heard and distinguished. Listeners with unilateral deafness will finally be able to approximate true stereo sound and get the full experience of their music, games, etc. through a pair of headphones. Individuals with normal hearing can benefit from the invention when they want to keep one ear free to hear their surroundings while listening to music.

While the above description contains many specifics, these should be construed as suggestions of embodiment rather than limitations of scope. For example, a variant embodiment could utilize either a standard open- or closed-back earpiece, rather than a convertible earpiece with removable cap. Another embodiment could utilize two functional earpieces—rather than one functional and one dummy earpiece—either of which could be selectively turned off by means of a switch. A further embodiment could contain only one earpiece, as in a standard, single-sided headset. Furthermore, the earpieces of the headphone need not be embodied in an over-ear style, but could rest on the ear, or clipped over the ear.

Accordingly, the scope should be determined not by the embodiment described but by the appended claims and their legal equivalents.

We claim:

1. A circumaural audio headphone comprising:

an earcup configured to overlie a pinna of a first ear of a user;

a first transducer supported in the earcup to convert a first audio signal to first sound waves that are provided directly to the pinna of the first ear, wherein the first transducer is connected to receive the first audio signal from a left stereo channel of an external stereo audio playback device;

a second transducer supported in the earcup to convert a second audio signal to second sound waves that are provided directly to the pinna of the first ear, wherein the second transducer is connected to receive the second audio signal from a right stereo channel of the external stereo audio playback device;

wherein the first transducer and second transducer are spatially displaced from one another in the earcup so that the first sound waves from the first transducer and the second sound waves from the second transducer are directly provided to the pinna of the ear via an unobstructed path and without occluding the ear canal of the first ear of the user; and wherein the earcup comprises a removable backpiece to allow the user to configure the earcup as an open earcup to allow external sound to enter the earcup and pass through an opening to allow the user to monitor the external sound, and as a closed earcup configured to block external sound from entering into the earcup, wherein the first and second transducers are located on opposite sides of the opening.

2. The circumaural audio headphone of claim 1, further comprising a dummy earcup configured to fit on a second ear of the user.

3. The circumaural audio headphone of claim 1, further comprising a switch supported by the circumaural audio headphone to swap the first audio signal with the second audio signal.

4. The circumaural audio headphone of claim 1, wherein the first and second transducers are spatially displaced from one another along a generally vertical axis when the circumaural audio headphone is worn by the user.

5. The circumaural audio headphone of claim 1, further comprising a further earcup configured to overlie a pinna of a second ear of the user.

6. A circumaural audio headphone, comprising:

an earcup configured to overlie an external portion of a pinna of a first ear of a user;

two sound-emitting sources supported within the earcup, each of said sound-emitting sources being comprised of one or more transducers;

a first one of said two sound-emitting sources converting a first audio signal to first sound waves that correspond to a left stereo channel from a stereo audio playback device, and a second one of said two sound-emitting sources converting a second audio signal to second sound waves that correspond to a right stereo channel from said audio stereo playback device, said two sound-emitting sources being spatially displaced from one another in the earcup and positioned to directly provide the first and second sound waves to the pinna of the first ear via an unobstructed path and without occluding the ear canal of the first ear of the user; and wherein the earcup comprises a removable backpiece to allow the user to configure the earcup as an open earcup to allow external sound to enter the earcup and pass through an opening to allow the user to monitor the external sound, and as a closed earcup configured to block external sound from entering into the earcup, wherein said two sound-emitting sources are located on opposite sides of the opening.

7. The circumaural audio headphone of claim 6, further comprising a dummy earcup configured to fit on a second ear of the user.

8. The circumaural audio headphone of claim 6, further including a two-way switch configured to swap the first and second audio signals between said two sound-emitting sources.

9. The circumaural audio headphone of claim 8, wherein said earcup may be opened or closed using a removable backpiece.

* * * * *